US007121543B2

(12) United States Patent
Fujioka

(10) Patent No.: US 7,121,543 B2
(45) Date of Patent: Oct. 17, 2006

(54) RECORDING MEDIUM RECEIVER AND RECORDING APPARATUS INCORPORATING THE SAME

(75) Inventor: Satoshi Fujioka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 34 days.

(21) Appl. No.: 10/347,521

(22) Filed: Jan. 21, 2003

(65) Prior Publication Data

US 2003/0146565 A1 Aug. 7, 2003

(30) Foreign Application Priority Data

Jan. 22, 2002 (JP) ..... P2002-012389

(51) Int. Cl.
*B65H 31/00* (2006.01)

(52) U.S. Cl. ..... 271/207; 400/625; 271/213

(58) Field of Classification Search ..... 271/207, 271/213; 226/83, 118.1; 400/44.4; 248/130, 248/133, 138, 371, 394, 395; 211/41.72, 211/168, 126.1, 133.5, 78, 81, 170, 181.1, 211/169, 106

See application file for complete search history.

(56) References Cited

U.S. PATENT DOCUMENTS 4,265,442 A 5/1981 Cormier et al.
5,081,487 A * 1/1992 Hoyer et al. ..... 355/75
6,568,865 B1 * 5/2003 Fujioka et al. ..... 400/647.1

FOREIGN PATENT DOCUMENTS

| | | | |
|---|---|---|---|
| CN | 1176890 | A | 3/1998 |
| EP | 351480 | A1 * | 1/1990 |
| EP | 0 496 627 | A1 | 7/1992 |
| EP | 1 095 889 | A2 | 5/2001 |
| JP | 58-63633 | A | 4/1983 |
| JP | 63-73977 | U | 5/1988 |
| JP | 3-125753 | U | 12/1991 |
| JP | 03-130915 | U | 12/1991 |
| JP | 2001-19259 | A | 1/2001 |
| JP | 2001-310858 | A | 11/2001 |

* cited by examiner

*Primary Examiner*—Eileen D. Lillis
*Assistant Examiner*—Kaitlin Joerger
(74) *Attorney, Agent, or Firm*—Sughrue Mion, PLLC

(57) ABSTRACT

In a receiver for receiving a recording medium discharged from a recording apparatus, a pivotable receiving member receives the recording medium. A pivotable supporting member supports the receiving member so as to place one of a plurality of pivoting angles of the receiving member respectively associated with a plurality of using modes of the receiver. The receiver is provided in the leg section of the recording apparatus which is arranged below a discharging section from which the recording medium is discharged.

15 Claims, 16 Drawing Sheets

RECORDING MEDIUM RECEIVER AND RECORDING APPARATUS INCORPORATING THE SAME

BACKGROUND OF THE INVENTION

The present invention relates to a receiver for receiving a recording medium which has been discharged from a recording apparatus, and also relates to a recording apparatus provided with this receiver.

As a printer which is a kind of recording apparatus, there has been a large size printer which can form print on a recording medium having a relatively large size, for example, rolled paper used for printing and having a width of an A0 size or B0 size according to the JIS (Japanese Industrial Standard) standard. In case of such a large size printer, the rolled paper on which printing has been performed is usually received by a discharged paper receiver which is located below a printer body. This discharged paper receiver is constructed in such a manner that the rolled paper which has been cut to have a relatively short length may be received behind the printer, because the cut sheets can be stacked, while the rolled paper which has been cut to have a relatively long length may be received in front of the printer body so that the cut sheets can be immediately taken out.

The discharged paper receiver as described above is provided in a form projecting forward and backward from the printer body, in order to cope with the rolled paper of a relatively large size. For this reason, the discharged paper receiver may become an obstacle when the printer is to be moved, and therefore, on occasion of transporting the printer, it has been necessary to dismount the discharged paper receiver from the printer, which has been annoying. On the other hand, there has been a discharged paper receiver of such a type that a cloth may be spread or folded according to modes for use, and further, locking positions of rod members for forming a framework of the cloth may be varied. However, this type of the receiver has had a complicated structure and has required annoying works.

SUMMARY OF THE INVENTION

It is therefore an object of the invention to provide a receiver for a recording medium having a simple structure in which modes for use on occasion of transportation or on occasion of discharging the recording medium can be easily changed, and a recording apparatus provided with such a receiver.

In order to achieve the above object, according to the invention, there is provided a receiver for receiving a recording medium discharged from a recording apparatus, the receiver comprising:

a pivotable receiving member, which receives the recording medium; and a pivotable supporting member, which supports the receiving member so as to place one of a plurality of pivoting angles of the receiving member respectively associated with a plurality of using modes of the receiver.

It is preferable that: a first end portion of the supporting member serves as a first pivot center of the supporting member while supporting a part of the receiving member which is other than a pivot center of the receiving member; and a second end portion of the supporting member serves as a second pivot center of the supporting member which is displaced in accordance with the using modes.

Here, it is preferable that the receiver further comprises a guide member, which allows the displacement of the second end portion of the supporting member and holds the second end portion at one of a plurality of predetermined positions respectively associated with the predetermined pivoting angles of the receiving member.

Here, it is preferable that the guide member includes a fixed member and a movable member which is usually placed at a stable position for holding the second end portion of the supporting member at one of the predetermined positions together with the fixed member, and is moved from the stable position for allowing the displacement of the second end portion of the supporting member.

Here, it is preferable that the guide member includes an elastic member which urges the movable member toward the stable position, so that the movable member is moved against an urging force of the elastic member when the displacement of the second end portion of the supporting member is allowed.

Further, it is preferable that the guide member includes a guide portion formed with a plurality of recesses which are associated with the respective predetermined positions and a passage interconnecting the recesses through which the second end portion of the supporting member is displaced.

According to the invention, there is also provided a recording apparatus, comprising:

a feeding section, from which a recording medium is fed;

a recording section, at which information is recorded on the recording medium, the recording section arranged below the feeding section;

a discharging section, from which the recording medium on which recoding has been performed is discharged, the discharging section arranged below the recording section; and a leg section, in which the receiver as set forth in claim 1 is provided, the leg section arranged below the discharging section.

Preferably, the receiving member is pivotable between a substantially horizontal position and a substantially vertical position at a front side of the recording apparatus.

Preferably, the using modes includes a first mode selected when the recording medium is fed back to the feeding section, a second mode selected when the recording medium is mounted onto the feeding section, and a plurality of receiving modes selected in accordance with conditions of the recording.

Preferably, a first end portion of the receiving member is supported by the leg section as a pivot center, and a second end portion of the receiving member is adapted to be actuated by a user to select one of the predetermined pivoting angles of the receiving member.

In the above configurations, the receiver can be of a simple structure essentially including a receiving member and a supporting member. Therefore, it is possible to cope with not only the mode for use on occasion of discharging the recording medium but also the mode for use on occasion of transporting the recording apparatus, only by setting a plurality of predetermined pivoting angles in which the receiving member is supported by the supporting member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of the present invention will be described in detail referring to the accompanying drawings.

Figure 1:
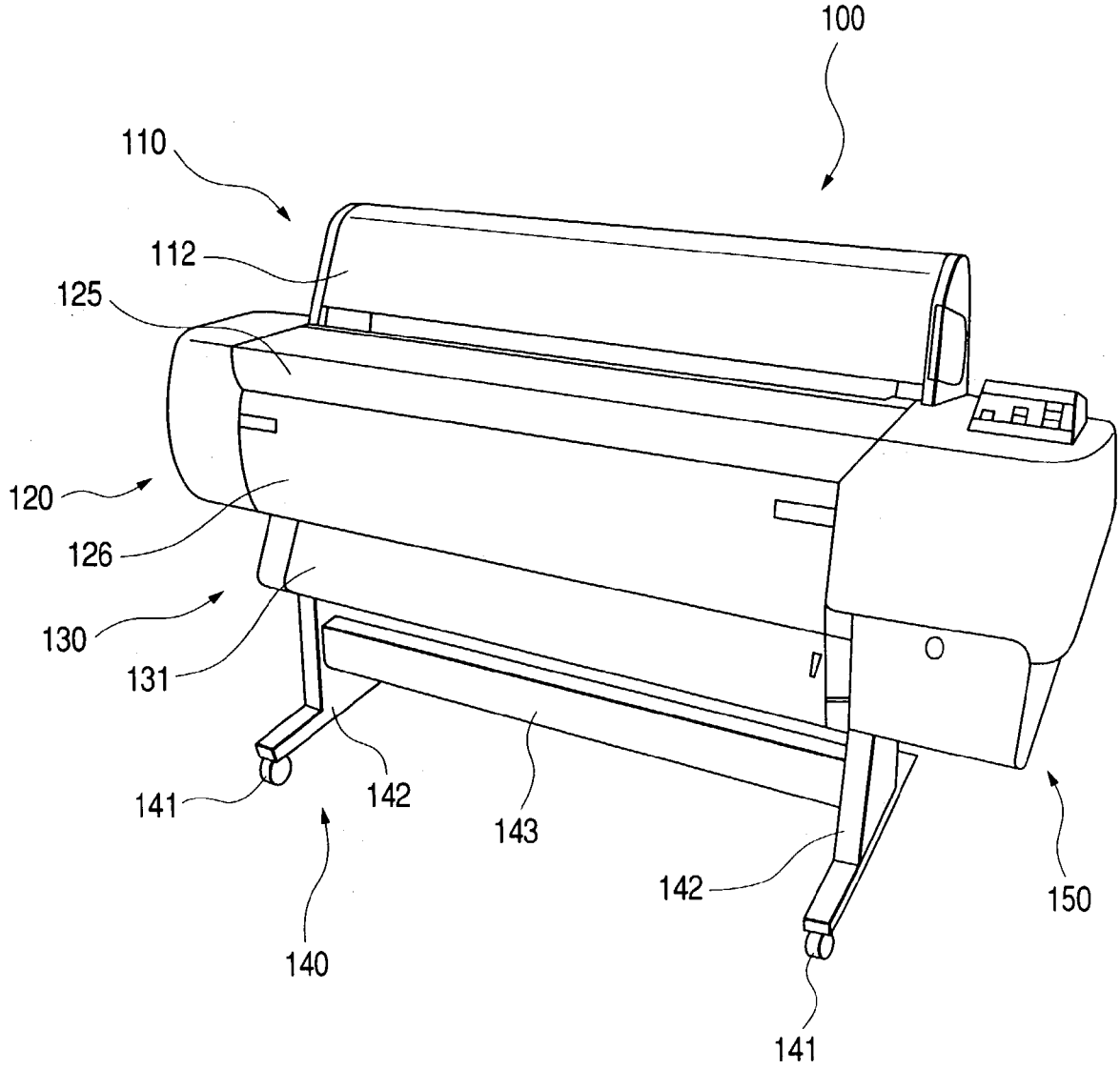
FIG. 1 is a perspective view showing a structure of a printer according to an embodiment of the present invention.
Figure 2:
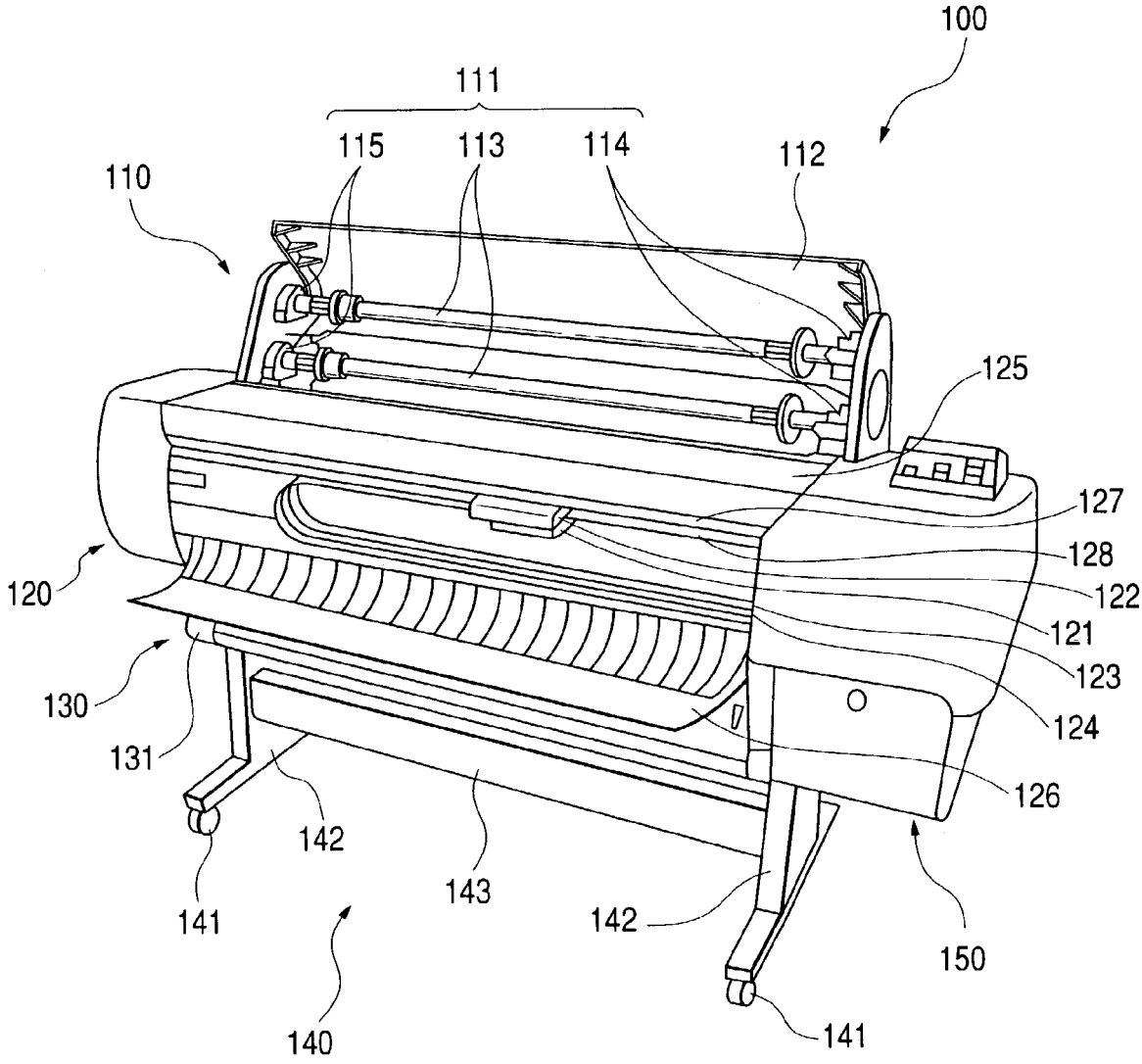
FIG. 2 is a perspective view showing an inner structure of an essential part of the printer.

A printer 100 as shown in FIGS. 1 and 2 is an ink jet printer of a large size by which printing can be performed on printing paper up to a relatively large size such as an A0 size and a B0 size according to the JIS standard. The printer 100 has such a structure that a paper feeding section 110, a printing section 120, a paper discharging section 130 and a leg section 140 are arranged in this order from the above. The paper feeding section 110 is detachably provided with respect to the printing section 120 and the paper discharging section 130 which are integrated, and these sections are formed as a printer body. This printer body is detachably provided with respect to the leg section 140.

The paper feeding section 110 is provided so as to project backward from a top of the printing section 120, as shown in FIG. 1. Inside the paper feeding section 110, there are provided, diagonally above and below, a pair of rolled paper holders 111 on which the rolled paper (printing paper) can be set, as shown in FIG. 2. Moreover, a lift-up type cover 112 for the rolled paper to be opened or closed is fitted to a front face of the paper feeding section 110 so as to cover the rolled paper holders 111.

Each of the rolled paper holders 111 includes a spindle 113 for holding the rolled paper, and a pair of spindle receivers 114, 115 which are attached to inner faces of both side walls of the paper feeding section 110 and capable of mounting, dismounting, and suspending the spindle 113. The spindle 113 is designed in such a manner that after the rolled paper has been mounted on a middle part of the spindle, both ends of the spindle 113 are received in the spindle receivers 114, 115 and axially supported so as to be rotated. The cover 112 for the rolled paper is rotatably supported at its upper part, and adapted to be opened or closed by lifting its lower part by hand or pushing it down.

As shown in FIG. 2, the printing section 120 includes: a carriage 122 carrying a printing head 121 in a main scanning direction; a flexible flat cable (hereinafter referred to as FFC) 123 connecting the printing head 121 to a not shown controller for conducting the printing; an ink tube 124 connecting the printing head 121 to a not shown ink cartridge unit containing ink therein; a not shown paper feeding roller for feeding the rolled paper in a subscanning direction; and a not shown paper sucker for preventing the rolled paper from floating up from the paper feeding path. In addition, an upper cover 125 and a front cover 126 are attached to an upper face and a front face of the printing section 120 so as to cover the printing head 121, the carriage 122, and so on.

The printing head 121 includes a black ink printing head from which black ink is ejected, and a plurality of color ink printing heads from which inks in various colors such as yellow, light cyan, cyan, light magenta, magenta, etc. are ejected. Further, the printing head 121 is provided with pressure generating chambers and nozzle orifices communicated with the pressure generating chambers. Ink contained in each pressure generating chamber is pressurized so that an ink drop of a controlled size can be ejected from an associated nozzle orifice onto the rolled paper.

As shown in FIG. 2, the carriage 122 is suspended by way of a roller from a rail 127 extending in the main scanning direction and coupled to a carriage belt 128 so that the carriage 122 is adapted to follow the movements of the carriage belt 128 and to perform reciprocal movements guided by the rail 127 when the carriage belt 128 is actuated by a not shown carriage actuator.

The FFC 123 is connected to a connector of the controller at its one end and connected to a connector of the printing head 121 at the other end so as to transmit printing signals from the controller to the printing head 121. There are provided the ink tubes 124 for the inks in various colors. Respective one ends of the ink tubes 124 are connected to the respective ink cartridges for the corresponding colors by way of a compressor (not shown), and the other ends of the ink tubes 124 are connected to the respective printing heads 121 for the corresponding colors.

The ink tubes 124 are adapted to supply the various colors of ink, which have been pressurized by the compressor, from the ink cartridges to the printing heads 121. The front cover 126 is pivotably supported at its lower part, and adapted to be opened or closed by pushing down its upper part by hand or lifting it up.

The paper discharging section 130 includes: a paper discharging guide 131 which forms a part of the paper feeding path in the subscanning direction; and a paper discharging roller (not shown) for feeding the rolled paper in the subscanning direction. Moreover, on a right hand of the paper discharging section 130 as viewed from the front, there is provided a cartridge holder 150 which contains and holds the ink cartridges.

The leg section 140 includes a pair of supporting posts 142 having rollers 141 for transportation, and a reinforcing rod 143 which is extended between these supporting posts 142. The printer body is placed on the supporting posts 142 and fixed with screws.

Figure 3:
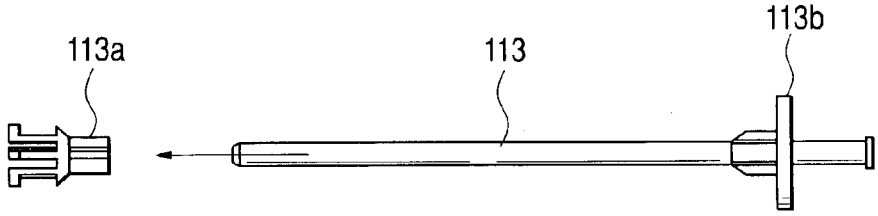
FIG. 3 is a first view showing steps of using the printer.

When the ink jet printer 100 having the above described structure starts to be used, at first, the spindle 113 which is a constituent of the rolled paper holder 111 will be taken out from the paper feeding section 110, and then, as shown in FIG. 3, a paper retainer 113*a* which has been inserted over the spindle 113 will be drawn out from an end of the spindle 113.

Figure 4:
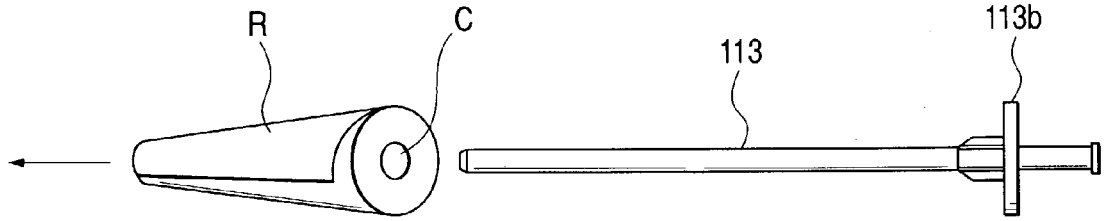
FIG. 4 is a second view showing the steps of using the printer.
Figure 5:
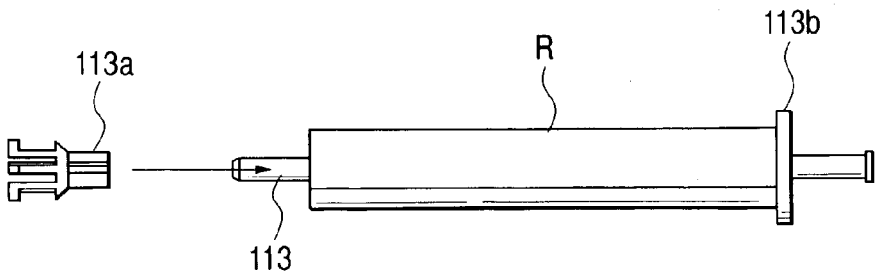
FIG. 5 is a third view showing the steps of using the printer.

Thereafter, as shown in FIG. 4, the one end of the spindle 113 will be inserted into an axial hole C of rolled paper R from its one end to pass through the axial hole, and as shown in FIG. 5, the one end of the axial hole C of the rolled paper R is fitted with a paper retainer 113*b* which has been inserted and fixed on the other end of the spindle 113. Subsequently, the paper retainer 113*a* is inserted from the one end of the spindle 113 to be fitted in the other end of the axial hole C of the rolled paper R. In this manner, the rolled paper R is allowed to rotate with the spindle 113.

Figure 6:
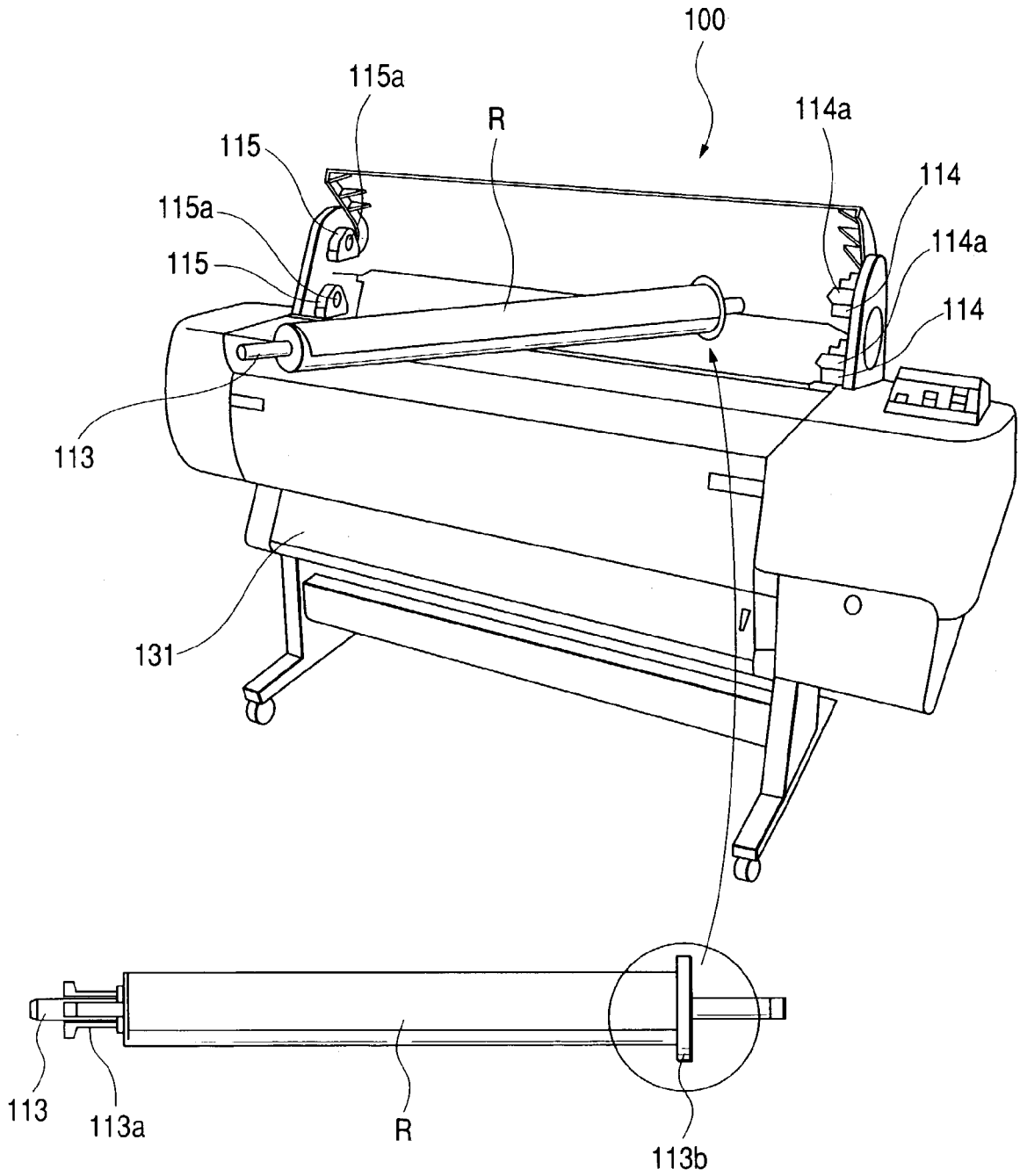
FIG. 6 is a fourth view showing the steps of using the printer.
Figure 7:
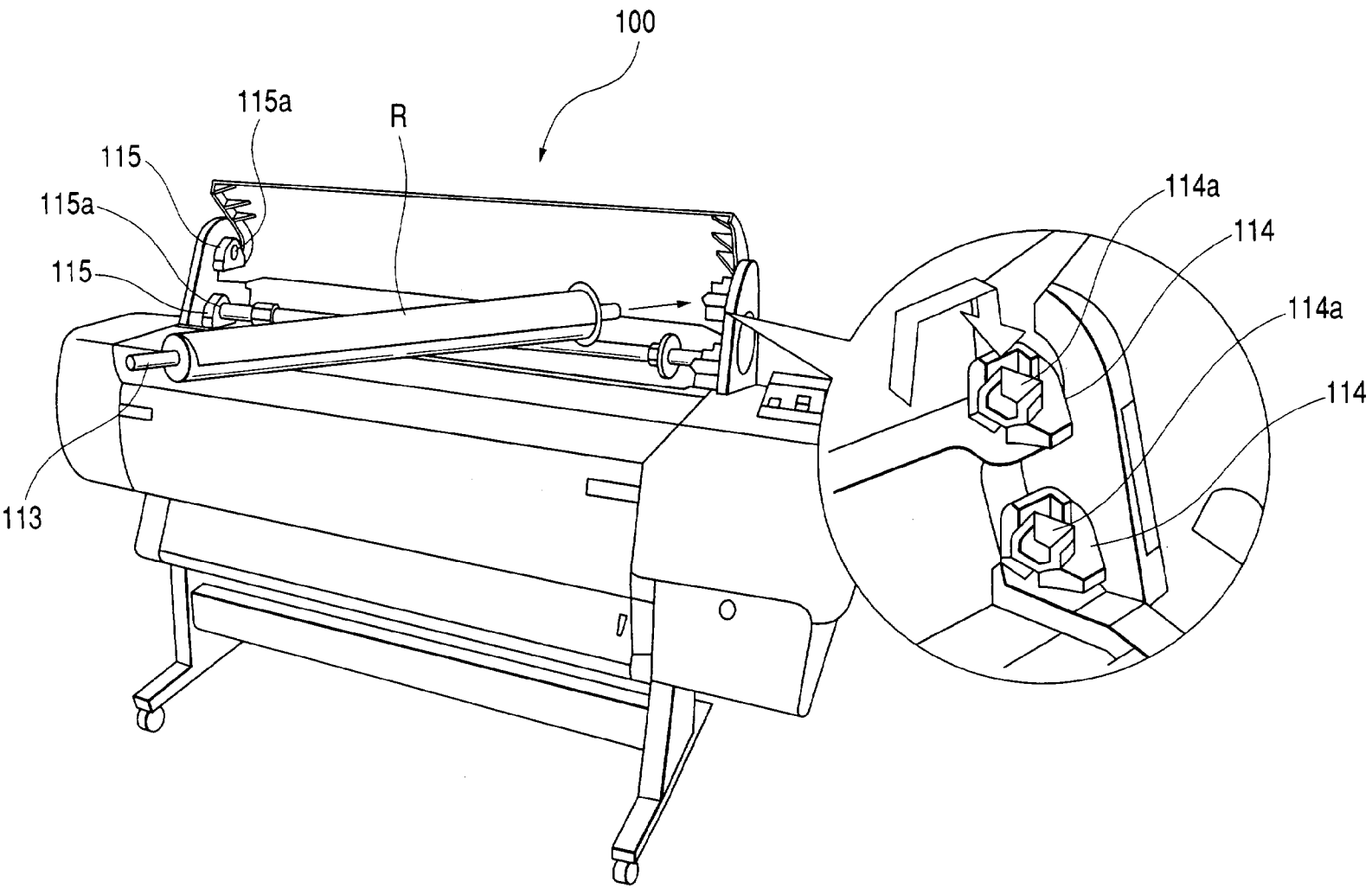
FIG. 7 is a fifth view showing the steps of using the printer.

Then, as shown in FIG. 6, both ends of the spindle 113 having the rolled paper R inserted thereon are held with hands, and the spindle 113 is placed into a diagonally oriented state with respect to a back and forth direction of the ink jet printer 100, in other words, in a state where the other end of the spindle 113 having the rolled paper R inserted thereon is directed toward one of the spindle receivers 114.

The spindle receiver 114 herein is so designed as to be pivoted in the horizontal direction, and respective recesses 114*a*, 115*a* of the spindle receivers 114, 115 for receiving the ends of the spindle 113 are usually opposed to each other. However, when the spindle 113 having the rolled paper R inserted thereon is to be mounted, one of the spindle receivers 114 will be pivoted forward to form an angle of about 45 degree with respect to the other spindle receiver 115.

Thereafter, the other end of the spindle 113 having the rolled paper R inserted thereon is hooked on the recess 114*a* of the one of the spindle receivers 114, and this spindle receiver 114 is pivoted together with the spindle 113 having the rolled paper R inserted thereon. Then, the respective recesses 114*a*, 115*a* of the spindle receivers 114, 115 are brought into an opposed state, and the other end of the spindle 113 having the rolled paper R inserted thereon is hooked on the recess 115*a* of the other spindle receiver 115. In this manner, the spindle 113 having the rolled paper R inserted thereon can be easily set in the paper feeding section 110.

Figure 8:
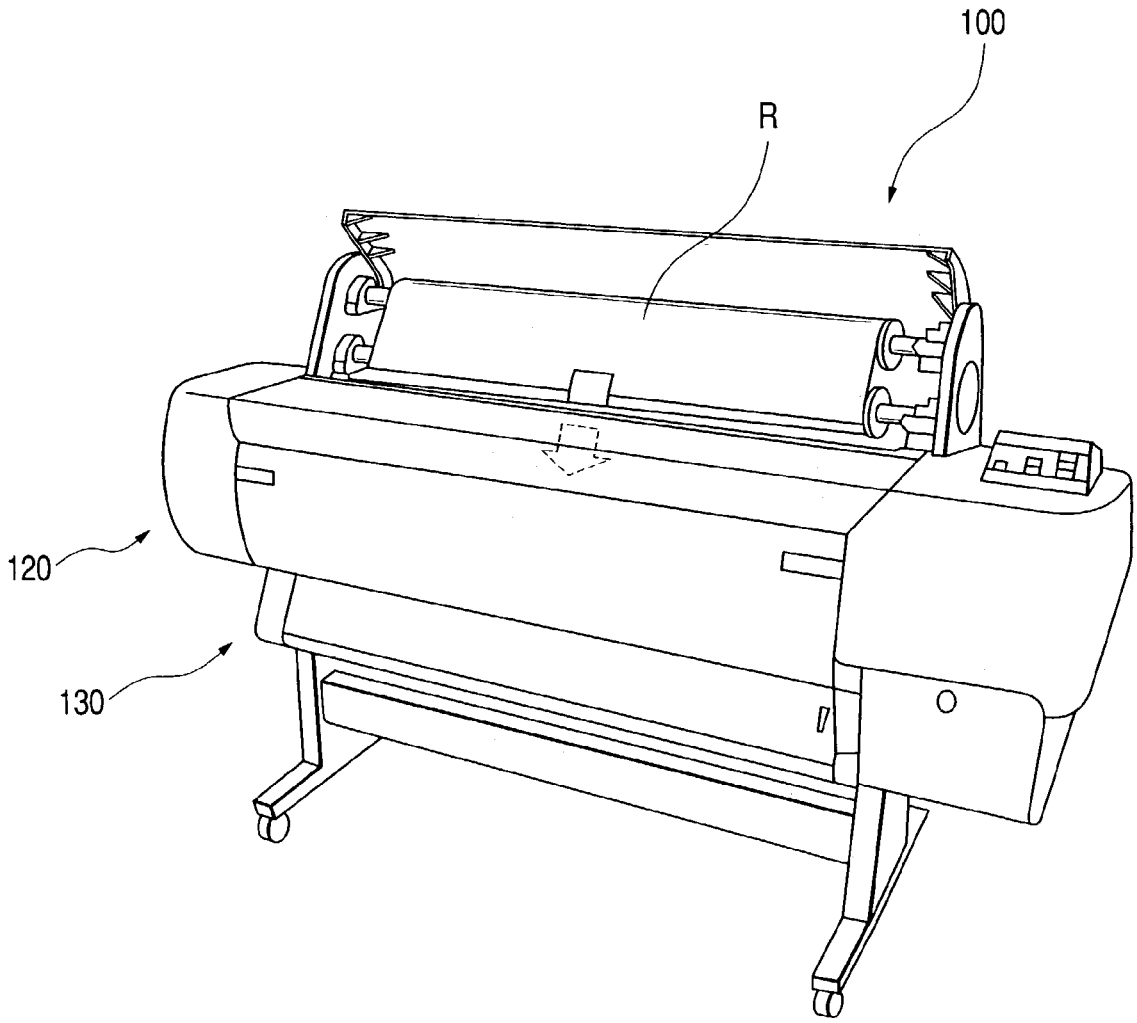
FIG. 8 is a sixth view showing the steps of using the printer.
Figure 9:
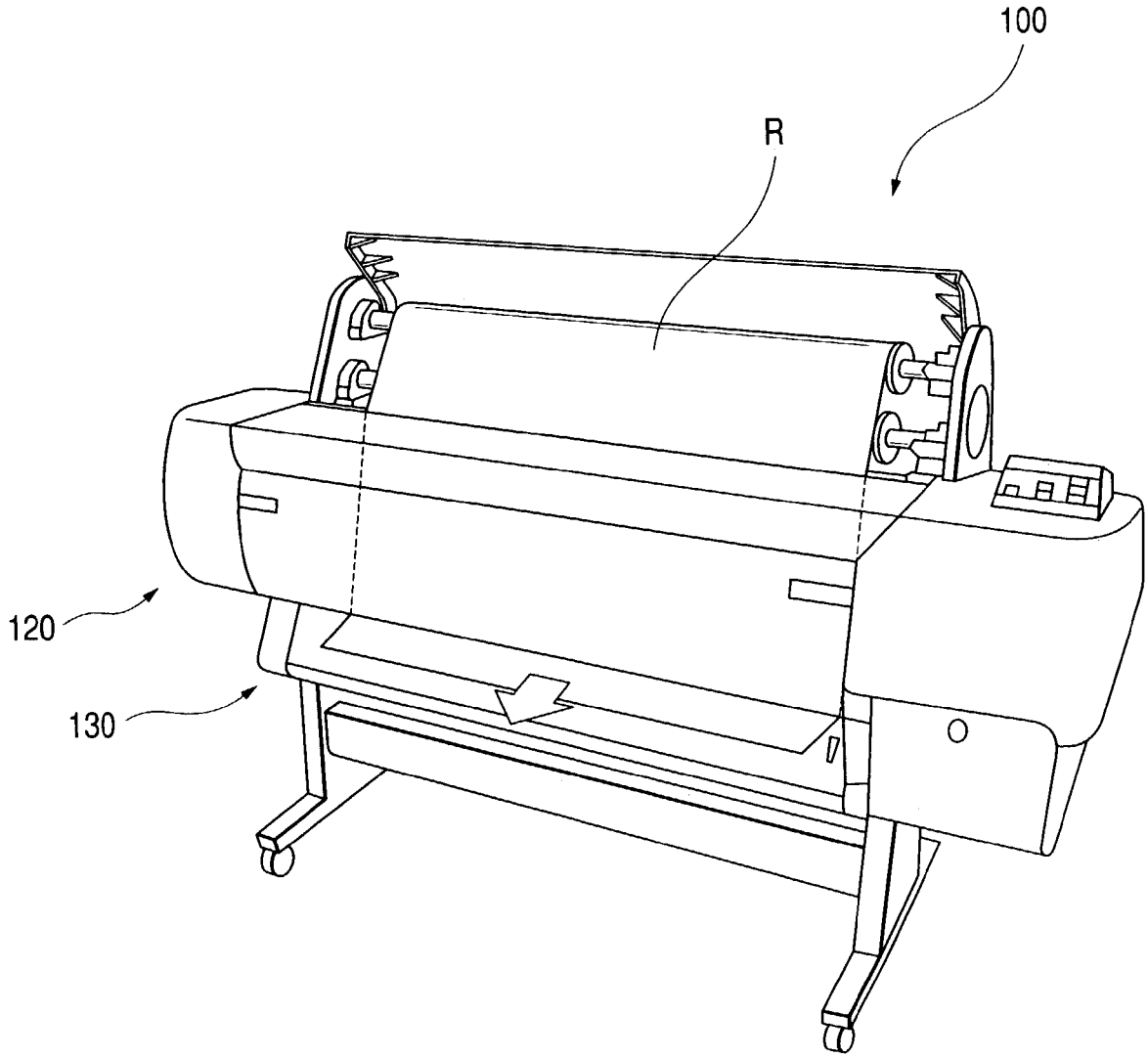
FIG. 9 is a seventh view showing the steps of using the printer.
Figure 10:
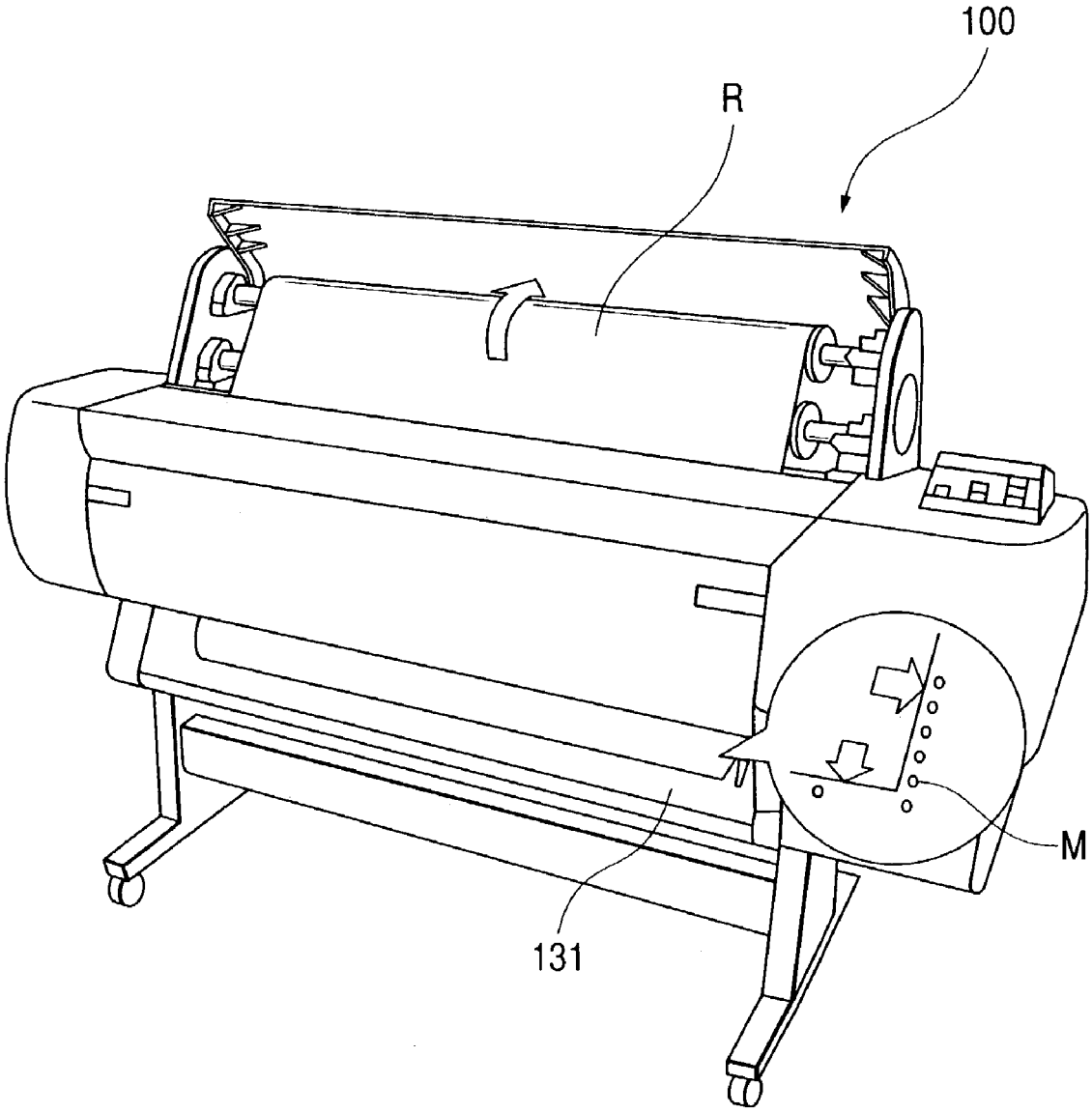
FIG. 10 is an eighth view showing the steps of using the printer.

Subsequently, as shown in FIG. 8, a leading end of the rolled paper R will be drawn out downward to pass through a paper feeding path in the printing section 120, and is further passed through a paper feeding path in the paper discharging section 130, as shown in FIG. 9. Then, the rolled paper R is rotated in a take-up direction as shown in FIG. 10, and the leading end of the rolled paper R is positioned at a marker M which is formed on the paper discharging guide 131, for example. Thereafter, the ink jet printer 100 is actuated to eject ink drops while the rolled paper R is fed in the subscanning direction, while the printing head 121 is moved in the main scanning direction. The rolled paper is discharged after predetermined information has been printed on the rolled paper R.

Figure 11:
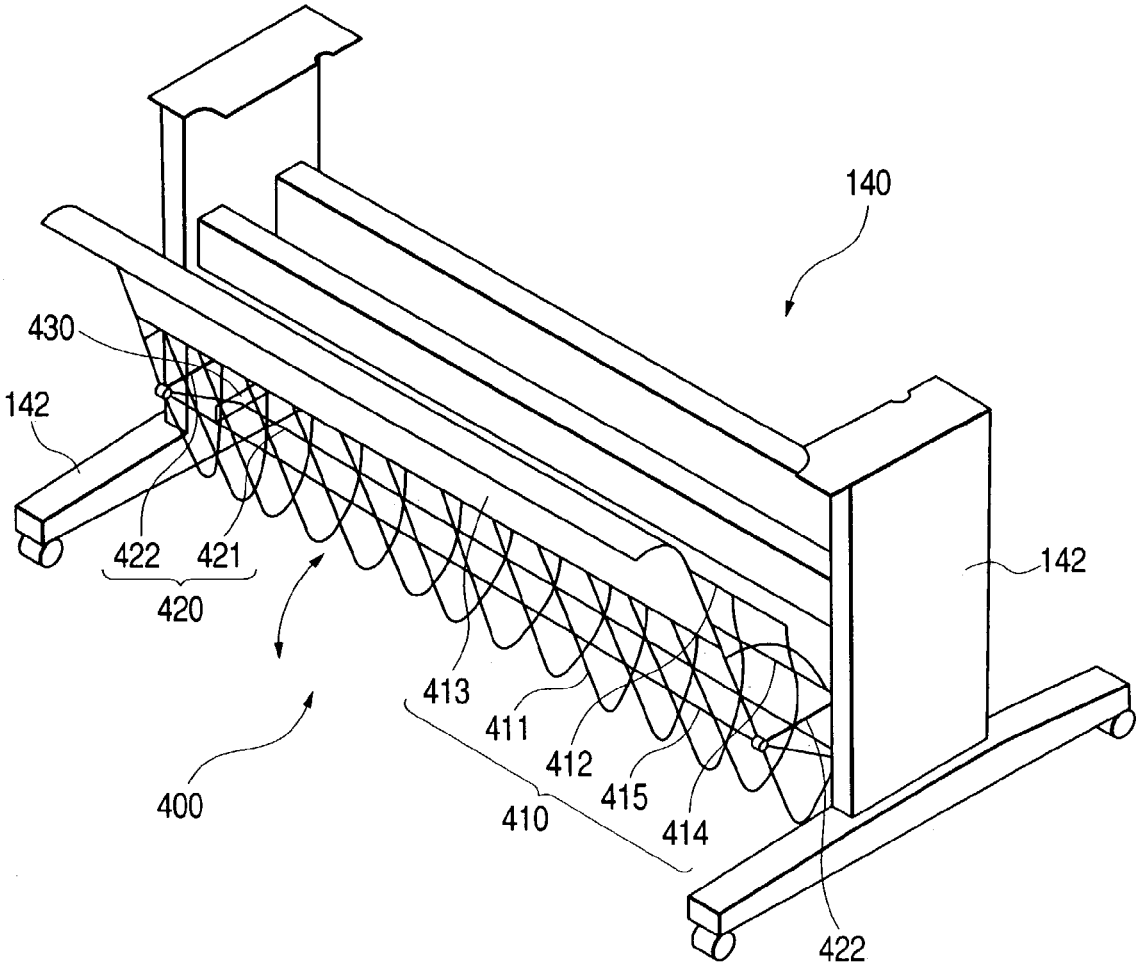
FIG. 11 is a perspective view showing a receiver to be incorporated in the printer.

As shown in FIG. 11, a receiver 400 includes: a paper tray 410 positioned between the supporting posts 142 in the leg section 140 and adapted to receive the rolled paper; a tray hook 420 provided between the supporting posts 142 in the leg section 140 and below the paper tray 410 so as to support the paper tray 410; and hook guides 430 provided on inner side faces of the supporting posts 142 and adapted to guide the movement of the tray hook 420.

Figure 12:
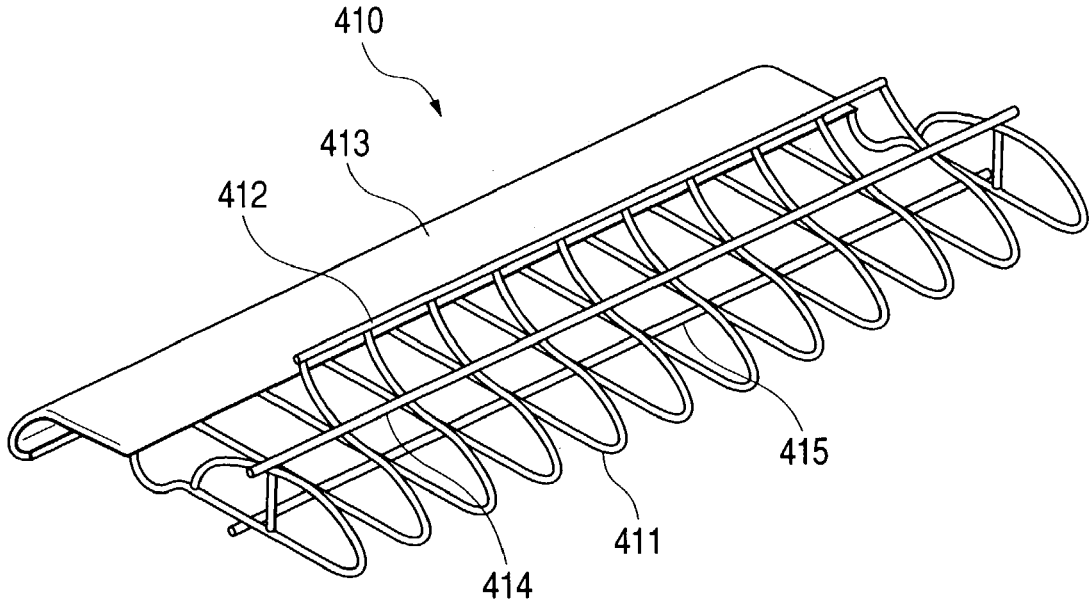
FIG. 12 is a perspective view showing a paper tray of the receiver.

As shown in FIG. 12, the paper tray 410 includes: a plurality of J-shaped rod members 411 arranged in parallel with each other at a constant interval; a straight rod member 412 connecting respective rear ends of the rod members 411, a cloth member 413 covering front ends of the rod members 411, a straight rod member 414 connecting respective middle parts of the rod members 411 at their rear end sides, and a straight rod member 415 connecting respective middle parts of the rod members 411 at their front end sides.

This paper tray 410 has such a structure, as shown in FIG. 11, that both ends of the straight rod member 414 are rotatably supported by bearings 416 (see FIG. 17) which are provided on the inner side faces of the supporting posts 142, and both ends of the straight rod member 415 are rotatably supported by front ends of the tray hook 420, so that the paper tray 410 can be pivoted about the rod member 414 in a direction of an arrow mark a (see FIGS. 18 to 20), in front of the leg section 140. Thus, the paper tray 410 is adapted to receive the rolled paper inside a curved face formed of a plurality of the J-shaped rod members 411.

Figure 13:
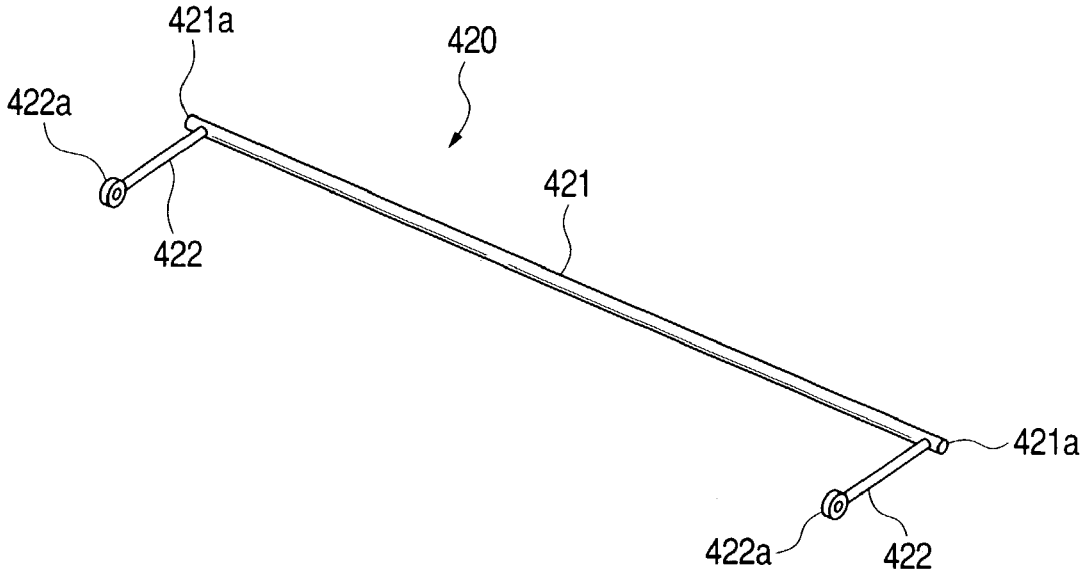
FIG. 13 is a perspective view showing a tray hook of the receiver.

As shown in FIG. 13, the tray hook 420 includes a straight rod member 421, and a pair of straight rod members 422 which are respectively provided at a right angle, near both ends 421*a* of this rod member 421. Respective front ends 422*a* of the rod members 422 are formed in a ring-like shape. This tray hook 420 is arranged in such a manner, as shown in FIG. 11, that the both ends 421*a* of the straight rod member 421 are rotatably supported by the hook guides 430, and the both ends of the straight rod member 415 of the paper tray 410 are rotatably fitted into the ring-like ends 422*a* of the rod members 422, so that the tray hook 420 can be pivoted about the rod member 421 together with the paper tray 410.

Figure 14:
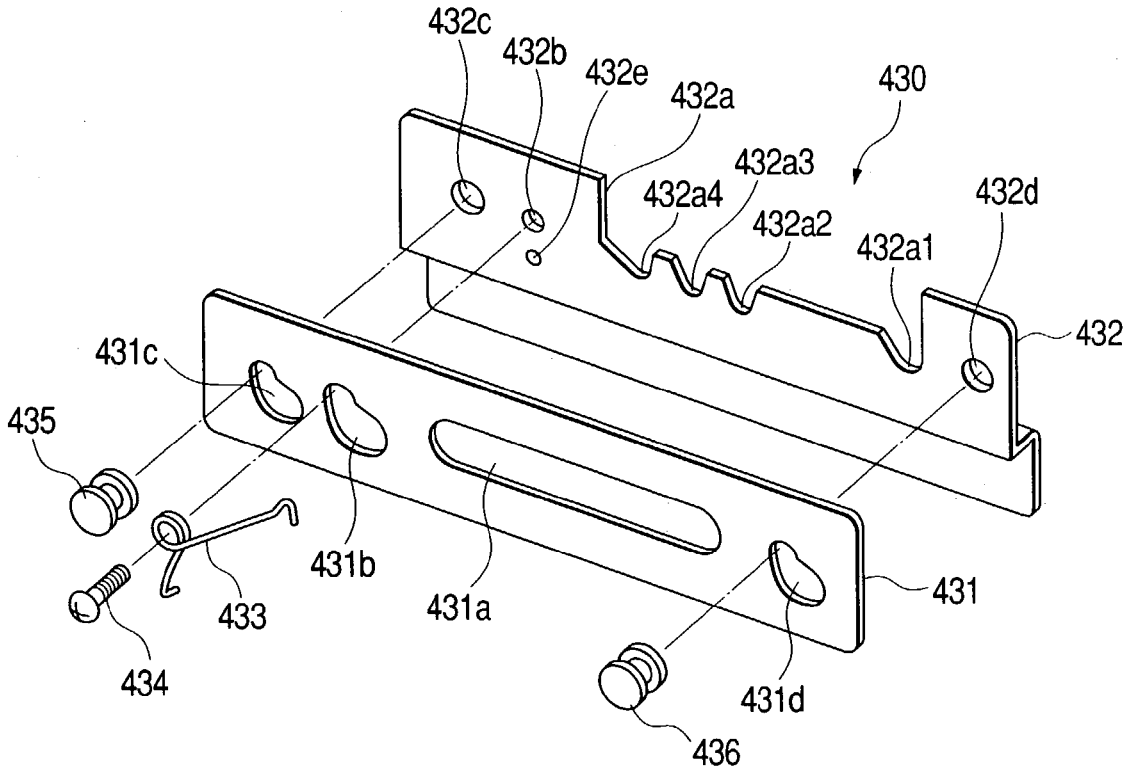
FIG. 14 is an exploded perspective view showing a hook guide.

As shown in FIG. 14, each of the hook guides 430 includes: a movable plate 431; a fixed plate 432; a twisted coil spring 433; a screw 434; and rivets 435, 436. The movable plate 431 is formed with: an elongated hole 431*a* into which each end 421*a* of the straight rod member 421 of the tray hook 420 can be inserted so as to be movable therein; a substantially L-shaped hole 431*b* into which the screw 434 fitted into the twisted coil spring 433 is inserted; and substantially L-shaped holes 431*c*, 431*d* into which the rivets 435, 436 are inserted.

The elongated hole 431*a* is formed longitudinally in a back and forth direction of the leg section 140, the hole 431*b* and the hole 431*c* are formed at a rear side of the elongated hole 431*a*, and the hole 431*d* is formed at a front side. The holes 431*b*, 431*c*, and 431*d* are formed in such a manner that the screw 434 and the rivets 435, 436 may not interfere within a range in which the movable plate 431 can move, in other words, within a moving range of the end 421*a* of the rod member 421.

The fixed plate 432 is formed with: a cut-out 432*a* for guiding movement of the end 421*a* of the straight rod member 421 of the tray hook 420; a threaded hole 432*b* into which the screw 434 fitted into the twisted coil spring 433 is screwed; circular holes 432*c*, 432*d* into which the rivets 435, 436 are inserted so as to be fixed; and a hole 432*e* with which a rear end of the twisted coil spring 433 is fitted.

The cut-out 432*a* is designed in such a manner that valleys are formed respectively at a first position 432*a*1, a second position 432*a*2, a third position 432*a*3 and a fourth position 432*a*4 in which the end of the rod member 421 is adapted to be positioned, and the positions 432*a*1, 432*a*2, 432*a*3 and 432*a*4 are connected by way of flat peaks. Accordingly, the end of the rod member 421 can travel from the valley at either of the positions 432*a*1, 432*a*2, 432*a*3 and 432*a*4, by way of the peak through a slope part, to another valley at either of the positions 432*a*1, 432*a*2, 432*a*3 and 432*a*4.

Figure 15:
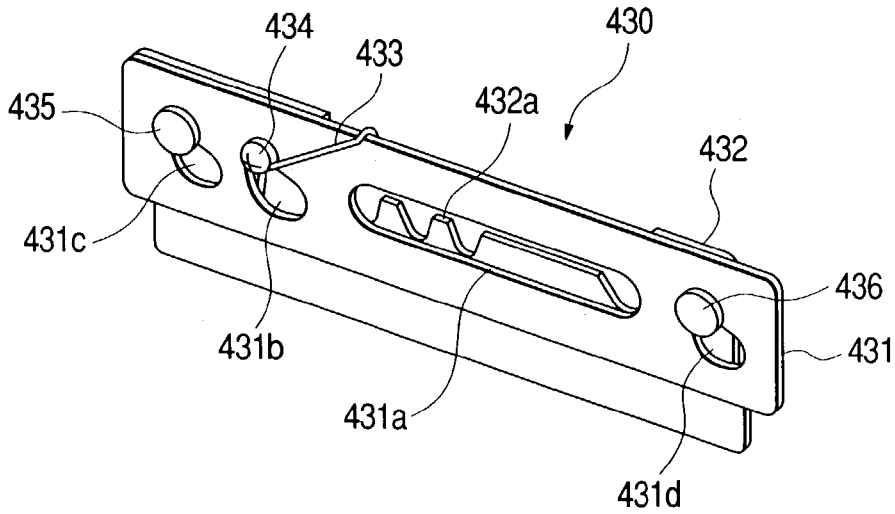
FIG. 15 is a perspective view showing an assembled state of the hook guide.

These components are joined and assembled as the hook guide 430, as shown in FIG. 15, through such processes that the movable plate 431 and the fixed plate 432 are overlapped, the twisted coil spring 433 is locked in the hole 432*e* at its rear end and hooked on an upper part of the movable plate 431 at its front end, the screw 434 which has been fitted into the twisted coil spring 433 is inserted into the hole 431*b* and screwed into the threaded hole 432*b*, and the separated rivets 435, 436 are respectively inserted into the holes 431*c*, 431*d*, through the circular holes 432*c*, 432*d*.

Then, the fixed plates 432 of the hook guide 430 shown in FIG. 15 and of the other hook guide 430 in symmetry therewith are fixed by screws to the inner side faces of the supporting posts 142 in the leg section 140, as shown in FIG. 11, so as to rotatably support the both ends 421*a* of the rod member 421 of the tray hook 420. Explanation will be made herein, referring to FIGS. 16A to 16D, about actions of the hook guide 430 when the end 421*a* of the rod member 421 travels from the second position 432*a*2 to the third position 432*a*3.

Figure 16A:
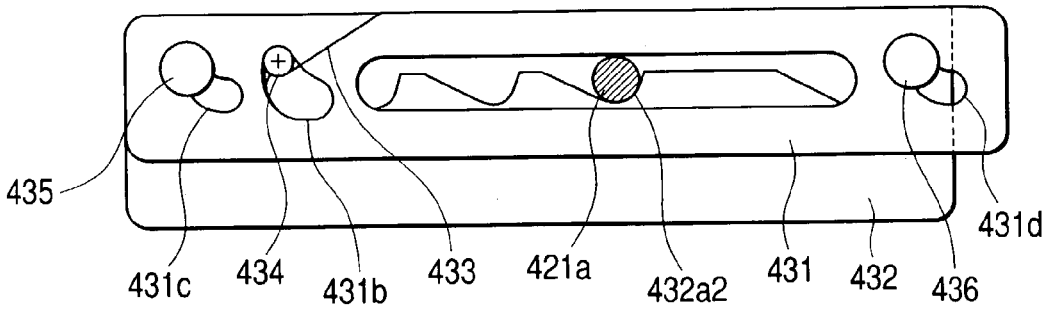
FIGS. 16A to 16D are plan views showing actions of the hook guide.

As shown in FIG. 16A, when the end 421*a* of the rod member 421 is positioned at the second position 432*a*2, the movable plate 431 is located in a lower position on the rightmost hand in the drawing, and the screw 434 and the rivets 435, 436 are located at upper positions on the leftmost hand in the drawing in the holes 431*b*, 431*c*, 431*d*.

Figure 16B:
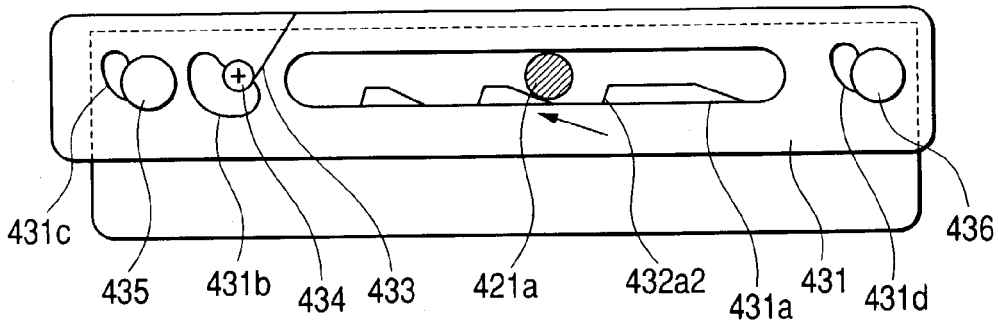

Then, as shown in FIG. 16B, when the end 421*a* of the rod member 421 has started to move from the valley at the second position 432*a*2 to the slope part, the end 421*a* of the rod member 421 presses an inner peripheral face of the elongated hole 431*a*, and the movable plate 431 is pushed upwardly to the left in the drawing. On this occasion, the screw 434 and the rivets 435, 436 are located at lower positions on the right hand in the drawing in the holes 431*b*, 431*c*, 431*d*, while the front end of the twisted coil spring 433 is elastically deformed.

Figure 16C:
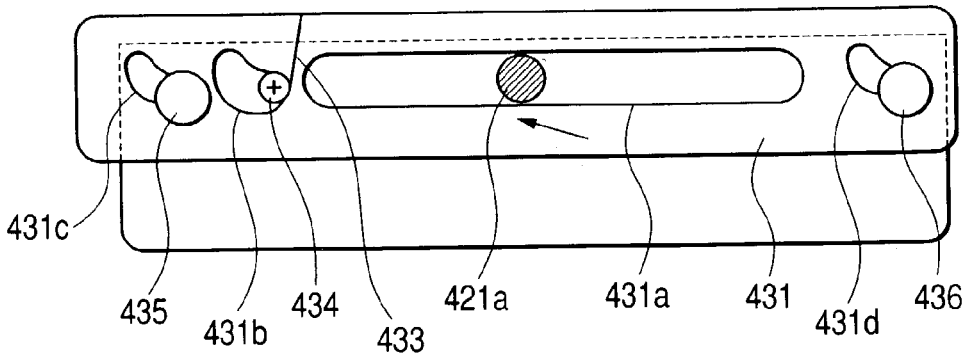

Further, as shown in FIG. 16C, when the end 421*a* of the rod member 421 has moved along the slope part to arrive at the peak interconnecting the second position 432*a*2 and the third position 432*a*3, the end 421*a* of the rod member 421 ceases to press the inner peripheral face of the elongated hole 431*a*, and only the end 421*a* of the rod member 421 moves along the flat peak part. On this occasion, the movable plate 431 is located at the upper position on the leftmost hand in the drawing, the screw 434 and the rivets 435, 436 are located at lower positions on the rightmost hand in the drawing in the holes 431*b*, 431*c*, 431*d*, while the front end of the twisted coil spring 433 is elastically deformed to a largest degree.

Figure 16D:
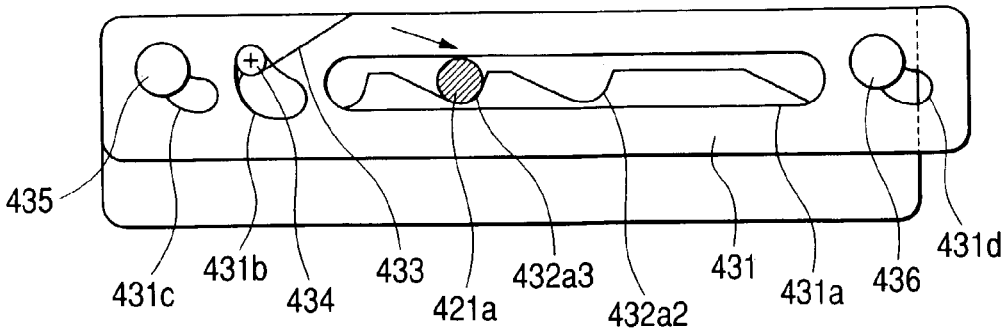

Finally, as shown in FIG. 16D, when the end 421*a* of the rod member 421 has been detached from the flat peak part interconnecting the second position 432*a*2 and the third position 432*a*3, since the movable plate 431 is pushed downward by restoring force of the front end of the twisted coil spring 433, the end 421*a* of the rod member 421 is pressed by the inner peripheral face of the elongated hole 431*a* and falls in the valley at the third position 432*a*3 to be positioned there.

When the end of the rod member 421 is positioned at the third position 432*a*3, the movable plate 431 is located in the lower position on the rightmost hand in the drawing which is the same state as in FIG. 16A, and the screw 434 and the rivets 435, 436 are located at the upper positions on the leftmost hand in the drawing in the holes 431*b*, 431*c*, 431*d*. The above described actions are also the same in those cases where the end 421*a* of the rod member 421 travels from the valley at either of the positions 432*a*1, 432*a*2, 432*a*3 and 432*a*4, by way of the flat peak part through the slope part, to any other valley at either of the positions 432*a*1, 432*a*2, 432*a*3 and 432*a*4.

Figure 17:
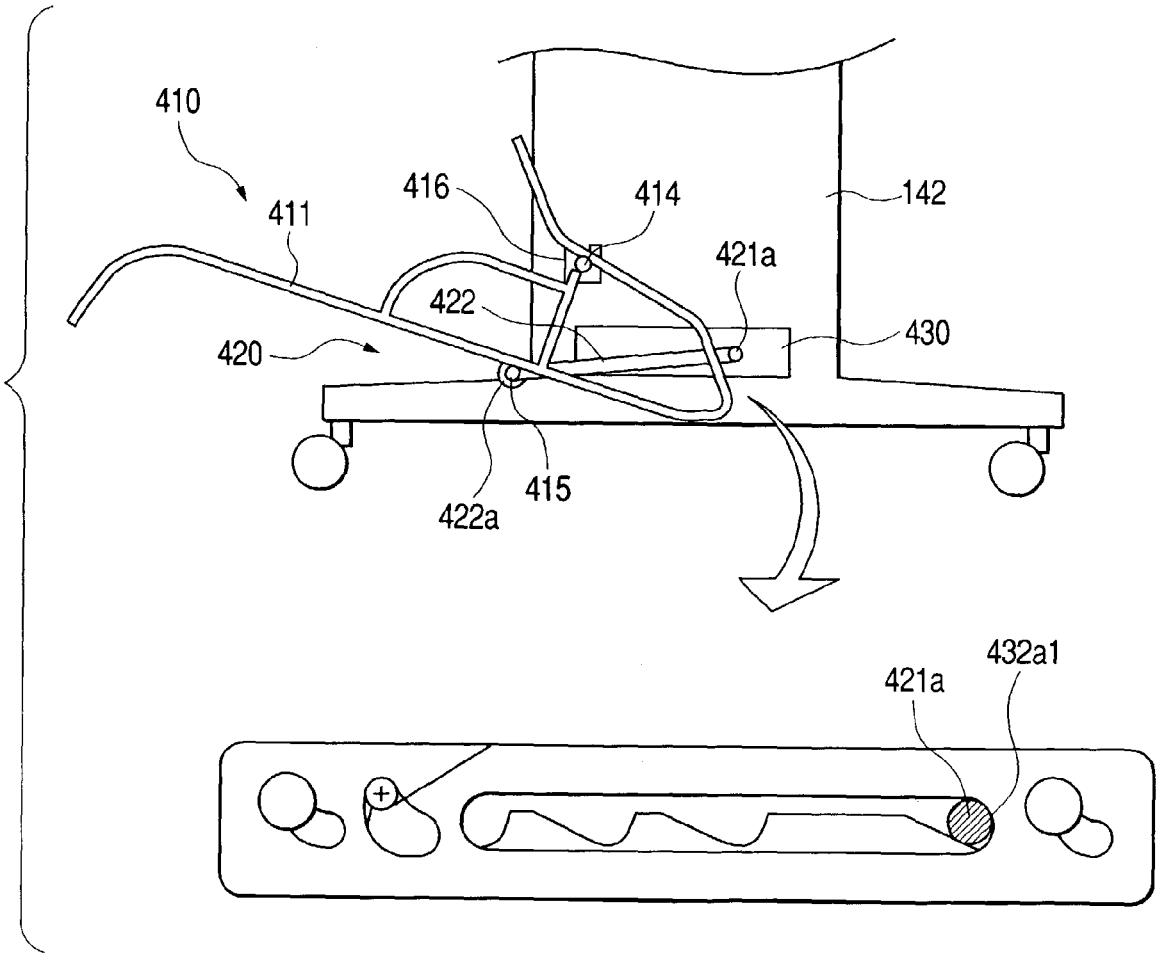
FIG. 17 is a first view showing modes for use of the receiver.

Modes for use of the receiver 400 will be described referring to FIGS. 17 to 20. The mode for use as shown in FIG. 17 is a rolled paper taking-up mode. In this mode, the paper tray 410 is in a state where the front ends of the J-shaped rod members 411 are rather lifted, for example, at about 20 degree from the horizontal position, and the tray hook 420 is in a state where the ends 421*a* of the rod member 421 are positioned at the first position 432*a*1.

Figure 18:
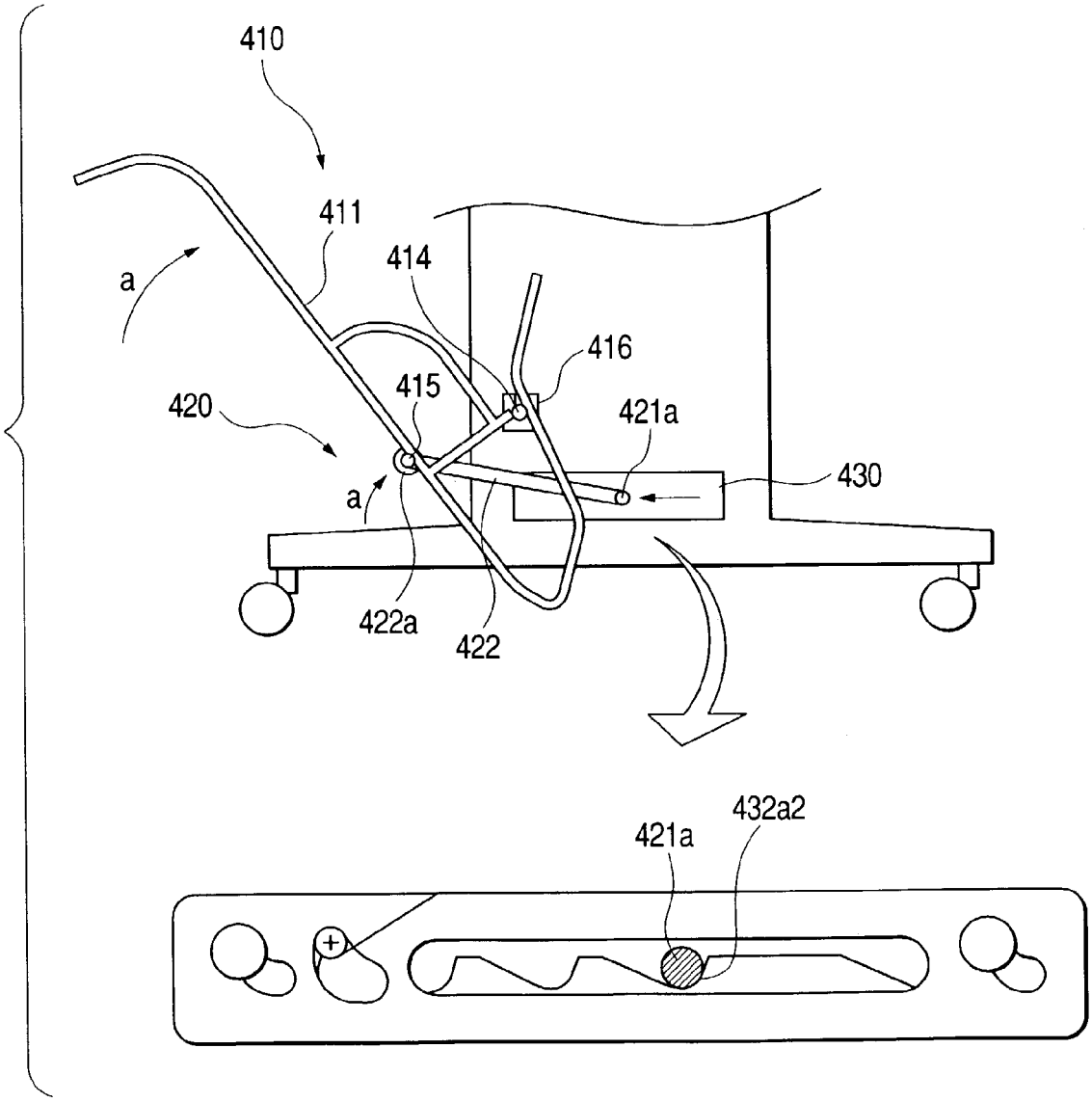
FIG. 18 is a second view showing the modes for use of the receiver.

The mode for use as shown in FIG. 18 is a first receiving mode of the discharged paper, in which the rolled paper which has been discharged utilizing curl in the rolled paper will be received and stocked. In order to change the mode from the taking-up mode in FIG. 17 to the first receiving mode in FIG. 18, it is sufficient that a user grasps the front ends of the J-shaped rod members 411 of the paper tray 410 and lift them upward.

In this manner, the paper tray 410 is pivoted upward about the rod member 414. Following this movement, the one ends 421*a* of the rod members 422 of the tray hook 420 is pivoted upward. At the same time, the ends 421*a* of the rod member 421 is moved forward in a horizontal direction guided by the hook guides 430, as described referring to FIGS. 16A to 16D. Since the tray hook 420 is accordingly pivoted, the paper tray 410 is placed in a state where the front ends of the J-shaped rod members 411 are lifted, for example, at about 55 degree from the horizontal position, and the tray hook 420 will be in a state where the ends of the rod member 421 are positioned at the second position 432*a*2.

Figure 19:
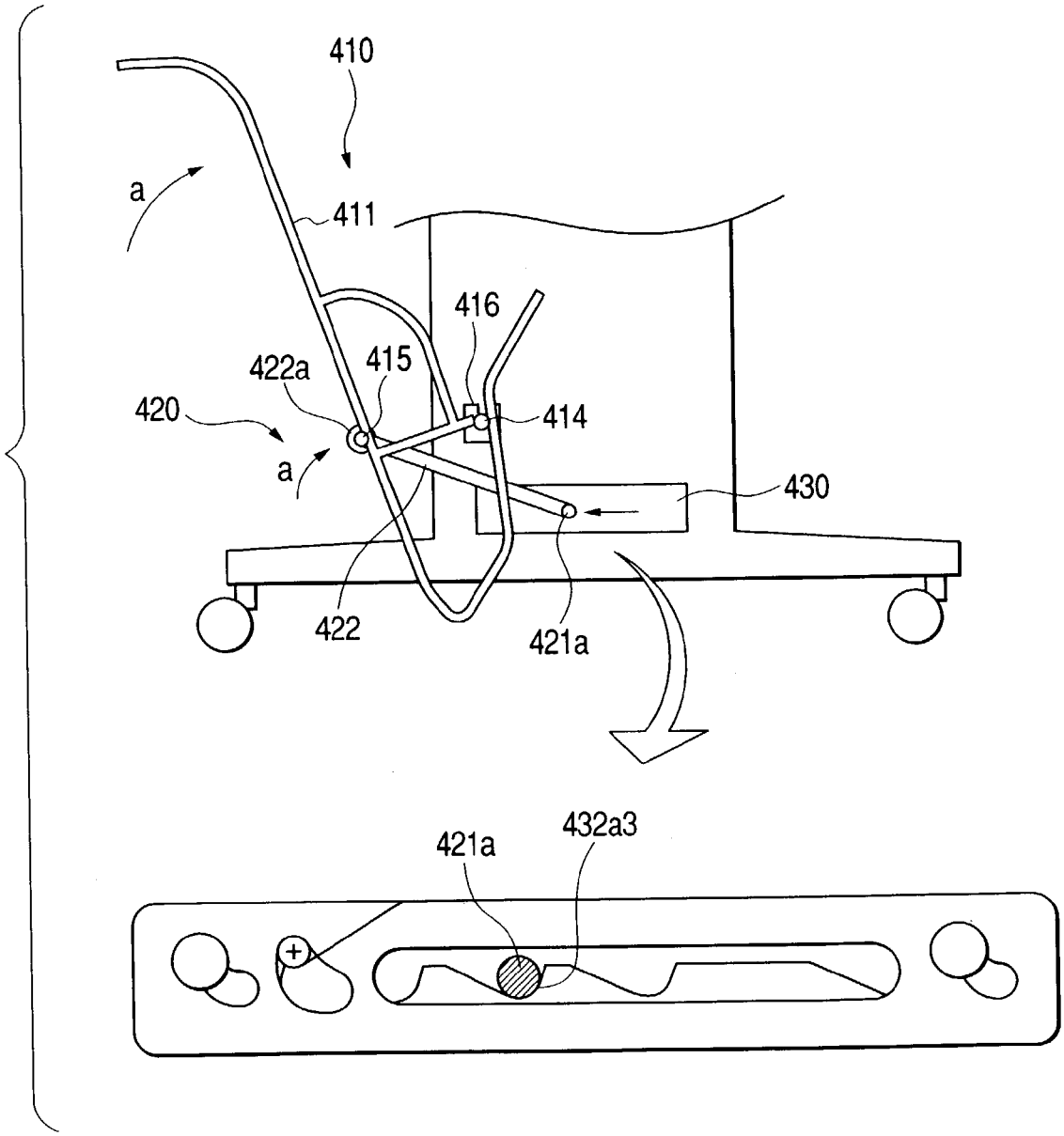
FIG. 19 is a third view showing the modes for use of the receiver.

The mode for use as shown in FIG. 19 is a second receiving mode of the discharged paper. When a large volume of ink has been used for conducting printing such as solid printing, the curl of the rolled paper is lost, and there is an anxiety that the leading end of the rolled paper may be caught by the paper tray 410 and a clog of the paper may occur. In order to overcome the anxiety, the rolled paper should be forcibly stored by increasing degree of the pivoting angle of the paper tray 410 in this second receiving mode. In order to change the mode from the first receiving mode in FIG. 18 to the second receiving mode in FIG. 19, it is also sufficient that the user grasps the front ends of the J-shaped rod members 411 of the paper tray 410 and lift them upward. Resultantly, the paper tray 410 is placed in a state where the front ends of the J-shaped rod members 411 are further lifted, for example, at about 70 degree from the horizontal position, and the tray hook 420 is placed in a state where the ends 421*a* of the rod member 421 are positioned at the third position 432*a*3.

Figure 20:
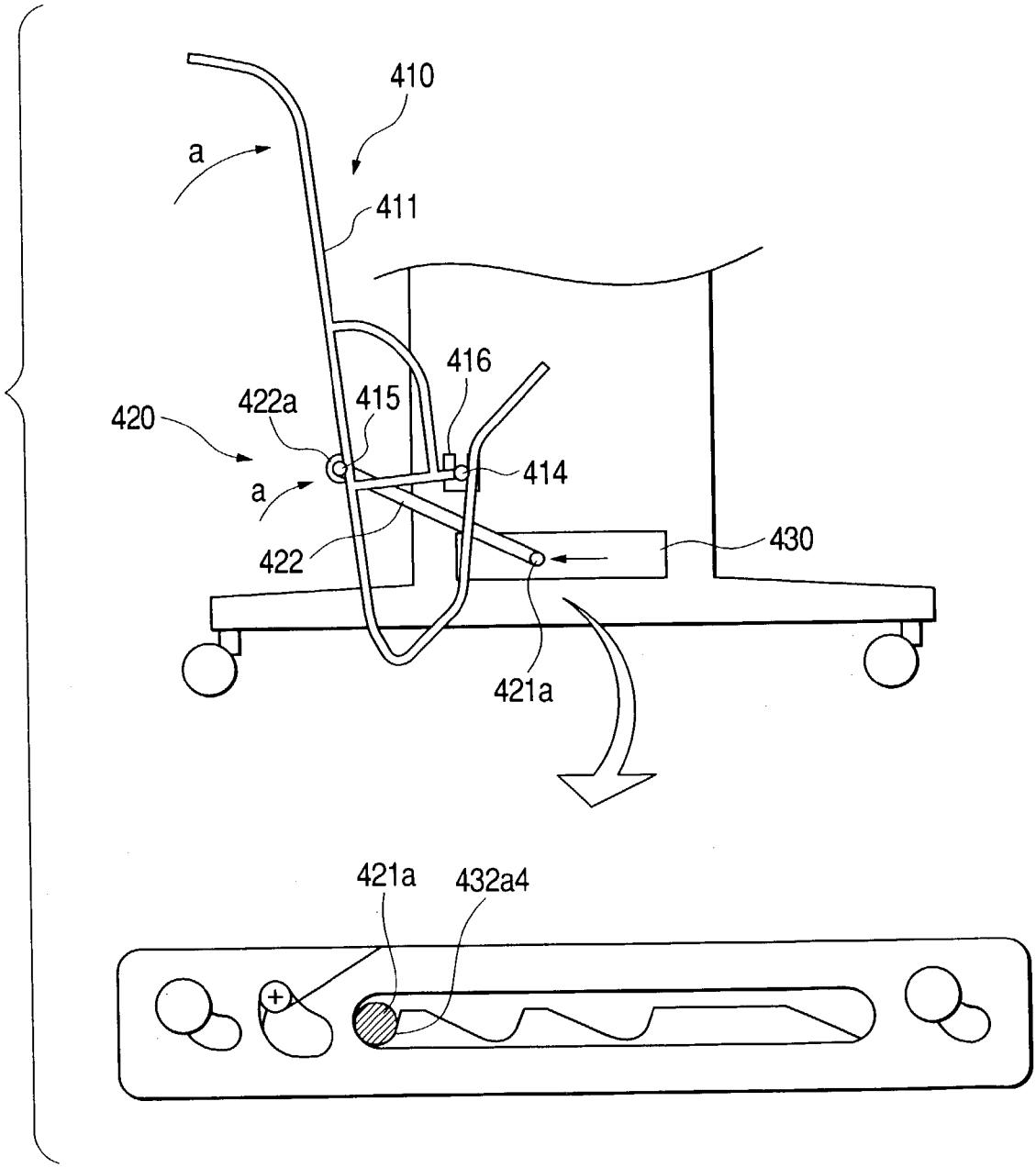
FIG. 20 is a fourth view showing the modes for use of the receiver.

The mode for use as shown in FIG. 20 is a rolled paper mounting mode, in which a distance between a position at which the user is standing and the rolled paper holder 111 can be minimized, when the rolled paper is set. In order to change the mode from the second receiving mode in FIG. 19 to the mounting mode in FIG. 20, it is also sufficient that the user grasps the front ends of the J-shaped rod members 411 of the paper tray 410 and lift them upward. Resultantly, the paper tray 410 is placed in a state where the front ends of the J-shaped rod members 411 are substantially upright, for example, at about 85 degree from the horizontal position, and the tray hook 420 is placed in a state where the ends 421*a* of the rod member 421 are positioned at the fourth position 432*a*4.

After the user has grasped the front ends of the J-shaped rod members 411 of the paper tray 410 and lifted them upward, only by pulling them forward and thereafter by pushing them downward, the ends 421*a* of the rod member 421 is guided by the hook guides 430 to move backward in a horizontal direction. Therefore, contrary to the above, the mode can be shifted from the mounting mode in FIG. 20 to the second receiving mode in FIG. 19.

In this embodiment, the case in which the receiver 400 is applied to the ink jet printer 100 has been described. However, the present invention is not limited to this embodiment, but the receiver 400 can be applied to printers of other types or facsimiles from which recording mediums are discharged.

What is claimed is:

1. A receiver for receiving a recording medium discharged from a recording apparatus, the receiver comprising:

a pivotable receiving member, which receives the recording medium; and a pivotable supporting member, which supports the receiving member so as to place one of a plurality of pivoting angles of the receiving member respectively associated with a plurality of using modes of the receiver;

wherein:

a first end portion of the supporting member serves as a first pivot center of the supporting member while supporting apart of the receiving member which is other than a pivot center of the receiving member and second end portion of the supporting member serves as a second pivot center of the supporting member which is displaced in accordance with the using modes; and further comprising:

a guide member, which allows the displacement of the second end portion of the supporting member and holds the second end portion at one of a plurality of predetermined positions respectively associated with the predetermined pivoting angles of the receiving member;

wherein the guide member includes a fixed member and a movable member which is usually placed at a stable position for holding the second end potion of the supporting member at one of the predetermined positions together with the fixed member, and is moved from the stable position for allowing the displacement of the second end portion of the supporting member.

2. The receiver as set forth in claim 1, wherein the guide member includes an elastic member which urges the movable member toward the stable position, so that the movable member is moved against an urging force of the elastic member when the displacement of the second end portion of the supporting member is allowed.

3. The receiver as set forth in claim 1, wherein the guide member includes a guide portion formed with a plurality of recesses which arc associated with the respective predetermined positions and a passage interconnecting the recesses through which the second end portion of the supporting member is displaced.

4. The receiver as set forth in claim 1, wherein the pivotable receiving member pivots around a first pivot center and the pivotable supporting member pivots around a second pivot center, which is different than the first pivot axis.

5. The receiver as set forth in claim 1, wherein the pivotable supporting member is pivotally coupled to the pivotable receiving member.

6. The receiver as set forth in claim 1, wherein the pivotable supporting member pivotally supports the pivotable receiving member at one end thereof, and another end of the pivotable supporting member is linearly displaceable.

7. A recording apparatus, comprising:

a feeding section, front which a recording medium is fed;

a recording section, at which information is recorded on the recording medium, the recording section arranged below the feeding section;

a discharging section, from which the recording medium on which recoding has been performed is discharged, the discharging section arranged below the recording section, and a leg section, in which the receiver as set forth in claim 1 is provided, the leg section arranged below the discharging section.

8. The recording apparatus as set forth in claim 7, wherein the receiver is pivotable between a substantially horizontal position and a substantially vertical position at a front side of the recording apparatus.

9. A recording apparatus comprising:

a feeding section, from which a recording medium is fed;

a recording section, at which information is recorded on the recording medium, the recording section arranged below the feeding section;

a discharging section, from which the recording medium on which recoding has been performed is discharged, the discharging section arranged below the recording section; and a leg section, in which a receiver is provided, the leg section arranged below the discharging section;

wherein the receiver comprises:

a pivotable receiving member, having a substantially U-shaped portion which receives the recording medium;

a pivotable supporting member, which supports the receiving member so as to place one of a plurality of pivoting angles of the receiving member respectively associated with a plurality of using modes of the receiver; and a guide member, which allows the displacement of the second end portion of the supporting member and holds the second end portion at one of a plurality of predetermined positions respectively associated with the predetermined pivoting angles of the receiving member wherein:

a first end portion of the supporting member serves as a first pivot center of the supporting member while supporting a part of the receiving member which is other than a pivot center of the receiving member and a second end portion of the supporting member serves as a second pivot center of the supporting member which is displaced in accordance with the using modes; and wherein the using modes includes a first mode selected when the recording medium is fed back to the feeding section, a second mode selected when the recording medium is mounted onto the feeding section, and a plurality of receiving modes selected in accordance with conditions of the recording.

10. A recording apparatus, comprising:

a feeding section, from which a recording medium is fed;

a recording section, at which information is recorded on the recording medium, the recording section arranged below the feeding section;

a discharging section, from which the recording medium on which recoding has been performed is discharged, the discharging section arranged below the recording section; and a leg section, in which a receiver is provided, the leg section arranged below the discharging section;

wherein the receiver comprises:

a pivotable receiving member, having a substantially U-shaped portion which receives the recording medium;

a pivotable supporting member, which supports the receiving member so as to place one of a plurality of pivoting angles of the receiving member respectively associated with a plurality of using modes of the receiver; and a guide member, which allows the displacement of the second end portion of the supporting member and holds the second end portion at one of a plurality of predetermined positions respectively associated with the predetermined pivoting angles of the receiving member wherein:

a first end portion of the supporting member serves as a first pivot center of the supporting member while supporting a part of the receiving member which is other than a pivot center of the receiving member and a second end portion of the supporting member serves as a second pivot center of the supporting member which is displaced in accordance with the using modes; and wherein a first end portion of the receiver is supported by the leg section as a pivot center, and a second end portion of the receiver is adapted to be actuated by a user to select one of the predetermined pivoting angles of the receiver.

11. An apparatus for receiving a recording medium discharged from a recording apparatus, comprising:

a tray that receives the recording medium and that pivots around a first pivot axis;

a rigid support structure that supports the tray and that pivots around a second pivot axis; and a guide which allows the displacement of the third pivot axis of rigid support structure and which holds the third pivot axis at one of a plurality of predetermined positions respectively associated with the operational modes;

wherein the first pivot axis is different from the second pivot axis, wherein the tray pivots around the first pivot axis and the rigid support structure pivots around the second pivot axis to position the tray at one of a plurality of pivoting angles respectively corresponding to a plurality of operational modes, and wherein the rigid support structure pivots around a third pivot axis, which is different than the first pivot axis and the second pivot axis;

wherein the rigid support structure supports the tray at the second pivot axis;

wherein a location of the third pivot axis is displaced with respect to the recording apparatus in accordance with the operational modes; and wherein the guide comprises:

a fixed member; and a movable member, wherein the movable member is located at a stable position to hold the third pivot axis at one of the predetermined positions in cooperation with the fixed member, and wherein the movable member moves from the stable position to allow the third pivot axis to be displaced.

12. The apparatus as claimed in claim 11, wherein the fixed member comprises:

a guide portion that includes a plurality of recesses, which are associated with the respective predetermined positions; and a passage interconnecting the recesses through which the third pivot axis is displaced.

13. The apparatus as claimed in claim 11, wherein the guide comprises an elastic member that urges the movable member towards the stable position.

14. The apparatus as claimed in claim 13, wherein the movable member moves against an urging farce of the elastic member when the third pivot axis is displaced.

15. The apparatus as claimed in claim 14, wherein the fixed member comprises:

a guide portion that includes a plurality of recesses, which are associated with the respective predetermined positions; and a passage interconnecting the recesses through which the third pivot axis is displaced.

* * * * *